US009931665B2

(12) United States Patent
Cheung et al.

(10) Patent No.: US 9,931,665 B2
(45) Date of Patent: Apr. 3, 2018

(54) MOTORIZED ADHESIVE DISPENSING MODULE

(71) Applicant: Flextronics AP, LLC, Broomfield, CO (US)

(72) Inventors: Dason Cheung, Fremont, CA (US); Murad Kurwa, San Jose, CA (US); Raymundo Alatorre Mercado, Campbell, CA (US)

(73) Assignee: Flextronics AP, LLC, Broomfield, CO (US)

( * ) Notice: Subject to any disclaimer, the term of this patent is extended or adjusted under 35 U.S.C. 154(b) by 215 days.

(21) Appl. No.: 14/526,114

(22) Filed: Oct. 28, 2014

(65) Prior Publication Data

US 2016/0114348 A1 Apr. 28, 2016

(51) Int. Cl.

| | |
|---|---|
| ***B05C 17/01*** | (2006.01) |
| ***B05C 5/02*** | (2006.01) |
| ***B05C 11/10*** | (2006.01) |
| *B05C 17/005* | (2006.01) |

(52) U.S. Cl.

CPC ..... *B05C 17/012* (2013.01); *B05C 5/0225* (2013.01); *B05C 11/1036* (2013.01); *B05C 17/00553* (2013.01); *B05C 17/0103* (2013.01); *B05C 17/014* (2013.01); *Y10S 901/16* (2013.01); *Y10S 901/21* (2013.01)

(58) Field of Classification Search

CPC ..... B05C 11/101; B05C 17/0103
USPC ..... 118/685, 683, 305
See application file for complete search history.

(56) References Cited

U.S. PATENT DOCUMENTS

| | | | | |
|---|---|---|---|---|
| 3,643,688 | A * | 2/1972 | Meinert | B67D 1/0016 137/556 |
| 3,952,920 | A | 4/1976 | Bergman | |
| 4,405,063 | A * | 9/1983 | Wydro | B29B 7/726 222/146.5 |
| 4,668,097 | A | 5/1987 | Nygren | |
| 4,678,100 | A | 7/1987 | Gelinas | |
| 4,692,351 | A | 9/1987 | Maeda | |
| 4,731,389 | A * | 3/1988 | Christopher | B29B 7/7438 264/42 |
| 4,835,401 | A * | 5/1989 | Sajiki | G03B 27/04 250/548 |
| 4,913,553 | A * | 4/1990 | Falco | B05C 17/00553 222/137 |

(Continued)

*Primary Examiner* — Karl Kurple
(74) *Attorney, Agent, or Firm* — Haverstock & Owens LLP

(57) ABSTRACT

A liquid compound dispensing apparatus for dispensing a controlled amount of liquid compound onto a workpiece is described. The apparatus comprises a cartridge system. The cartridge system may accept a liquid compound cartridge containing liquid compound. The apparatus also comprises a plate, having a threaded bore, positioned above the cartridge system that is movable in a first and second direction, at least one plunger attached to the plate at a first end and attached to a piston at a second end. The piston is dimensioned to move within the liquid compound cartridge to displace liquid compound when the plate is moved in the second direction. A driving mechanism moves the plate in the first and the second directions to dispense product and comprises a motor, a threaded rod disposed through the threaded bore of the plate that is driven by a driving belt attached to the motor.

10 Claims, 3 Drawing Sheets

(56) References Cited

U.S. PATENT DOCUMENTS 5,020,693 A * 6/1991 Ernst ..... B05C 17/015 222/137
5,273,187 A 12/1993 Suzuki
5,348,585 A * 9/1994 Weston ..... B05C 5/02 118/305
5,735,434 A 4/1998 Raynor
5,853,774 A * 12/1998 Dreve ..... B05C 17/0123 222/137
5,921,836 A * 7/1999 Nanto ..... H01J 9/227 445/24
6,061,608 A 5/2000 Moldavsky
6,361,831 B1 3/2002 Sato
6,365,226 B1 * 4/2002 Wu ..... F16K 1/2263 123/337
6,494,245 B1 * 12/2002 Simone ..... E06B 3/67343 156/107
6,527,905 B1 3/2003 Imanishi
8,444,025 B2 5/2013 Greter
8,757,450 B2 6/2014 Huang
8,770,141 B2 * 7/2014 Ikagawa ..... B05C 5/0262 118/682
9,016,235 B2 * 4/2015 Ikagawa ..... B05C 5/0258 118/323
9,162,249 B2 * 10/2015 Koyama ..... B05C 5/0225
2001/0038021 A1 11/2001 Villa
2002/0020350 A1 2/2002 Prentice
2003/0089731 A1 * 5/2003 Mayer ..... B01D 61/18 221/279
2004/0081759 A1 * 4/2004 Maruyama ..... B05C 5/0216 427/256
2004/0134619 A1 * 7/2004 Kojima ..... B05C 11/101 156/356
2005/0214172 A1 9/2005 Burgisser
2006/0147620 A1 7/2006 Kwon
2006/0283885 A1 * 12/2006 Dolman ..... B05C 17/00553 222/135
2007/0090128 A1 4/2007 Martin
2007/0175918 A1 * 8/2007 Wagner ..... A61C 5/064 222/63
2009/0008246 A1 * 1/2009 Reynolds ..... G01N 33/48757 204/400
2010/0262230 A1 * 10/2010 Vecerina ..... B05B 12/122 623/1.46
2014/0263402 A1 9/2014 Duinen
2015/0097006 A1 * 4/2015 Kimura ..... H01L 24/00 222/389
2016/0082454 A1 * 3/2016 Vogt ..... B05C 17/00559 427/421.1
2016/0114348 A1 4/2016 Cheung

* cited by examiner

MOTORIZED ADHESIVE DISPENSING MODULE

FIELD OF INVENTION

The present invention relates to liquid dispensing apparatus and methods. More particularly, the present invention relates to liquid dispensing apparatus and methods for dispensing single-part and multi-part compounds at precise volumes.

BACKGROUND

Single-part or one-part compounds may cure, set, or harden via a chemical reaction with an external energy source, such as radiation, heat, moisture or the like. Multi-part compounds may cure, set, or harden by mixing one or more component parts which chemically react. This reaction causes polymers to cross-link into acrylics, urethanes, and epoxies.

Polyepoxides, commonly known as epoxy resins or epoxies, are a class of reactive pre-polymers and polymers. As described above, epoxy resins may react with themselves, (e.g., one-part compound), or may react with various co-reactants, commonly referred to as hardeners or curatives, such as phenols, alcohols, and thiols, (e.g., two-part compounds). Reactions of epoxy resins, both with themselves or with a co-reactant, form a thermosetting polymer. Thermosetting polymers are generally characterized as strong, hard materials that are resistant to chemicals and temperature changes. Thermosetting polymers have a wide range of industrial applications, including adhesives, insulators, sealants, coatings, potting/encapsulation, automotive primer, use in electronic and electrical components, or the like.

Single-part or one-part compounds may be dispensed directly from their packaging, (e.g., a tube, a cartridge, or the like), whereas two-part compounds must be pre-mixed. Pre-mixing component parts ensures uniformity in the mixed components prior to a dispensing process. The pre-mixing process may be conducted manually or by an automated device.

A manual pre-mixing process generally requires a user to manually mix both component parts, for example with a mixing spatula and tray. This process is time consuming, results in a high rate of compound consumption, and is attributable to a high incidence of user rotation due to the physical labor required to mix the component parts. In addition, if the user employs a dispensing device, the user generally must load the compound into the dispensing device, which may result in a loss of some compound during a transfer.

Alternatively, an automated device may mix the two component parts and release the resulting compound into a separate compartment, such as a dispensing device, a dispensing syringe, or the like. Two-part compounds, generally characterized by limited working times, (e.g., 20 minutes or less), may begin to cure in the dispensing device and/or related components. This attribute may lead to clogging or inoperability of the dispensing device. This may result in increased maintenance, increased part replacement events, increased cleaning costs, and a high rate of liquid compound waste. One-part compounds may have similar limited working times and deficiencies. This problem may be common to high pressure dispensing valve systems with multiple component parts, such as a spool valve. Such systems are generally self-contained and are difficult to disassemble or are incapable of being disassembled. In such a system, a spool valve may become engulfed by cured compound and prevented from operating properly (e.g., the precision of liquid compound dispensed may vary substantially). Thus, there is a need for a dispensing system and related components that are designed to accommodate the limited working time of one-part and multi-part compounds.

Dispensing systems known in the art employ manual or pneumatically operated dispensing devices. Both manual and pneumatic dispensing devices use a time/pressure system. FIG. 1 is a diagram of a conventional time/pressure dispensing system 100. The time/pressure dispensing system 100 may be pneumatically operated. Referring to FIG. 1, there is shown a pneumatically operated dispensing syringe 105 comprising a plunger 115, and a tip 120. The dispensing syringe is attached to tube 110. Tube 110 may be attached to an air compressor and a vacuum. The compressor applies compressed air at a specific pressure to the plunger 115 to force a volume of a liquid compound 125 within the syringe 105 to be dispensed from the tip 120 onto a surface of a workpiece 130. In this time/pressure system, the higher the pressure and the longer it is applied, the greater the quantity of liquid compound will be dispensed. The vacuum may be used to prevent the liquid compound from dripping. Alternatively, no vacuum may be employed, and the liquid compound held within the syringe may be pulled back from the tip of the syringe due to a depressurization or decrease in the amount of applied pressure.

One of the deficiencies in such a time/pressure system is the inconsistent dispensing quantity caused by internal and external variations. For example, when pressure or force is applied to the liquid compound or a cartridge piston to dispense a quantity of liquid compound, there is a reactionary exertion of force on the piston in the opposite direction. This reaction force may increase when viscosity properties of the liquid compound increase. For example, pulsed pressure may heat the material, which may change the viscosity of the liquid compound and in turn may alter the volume of liquid compound that is dispensed. In addition, the reaction force may decrease as the amount of liquid compound in the dispensing device decreases. The dispensing pressure is generally maintained at a constant level and does not take into account the change in the reaction force, resulting in a high degree of variation in the quantity of liquid compound that is dispensed.

Moreover, additional dispensing parameters may vary as the syringe empties, resulting in variations in the amount of liquid compound dispensed. Vacuum-pull back systems may also be ineffective from preventing liquid compound from dripping and may pull the liquid compound away from the tip resulting in a variation in the volume of the next dispensed amount of liquid compound. Thus, there is a need for a dispensing device and related components that are designed to dispense precise amounts of liquid compound with a high degree of repeatability while taking into account the internal and external variations impacting such as system.

SUMMARY

A liquid compound dispensing apparatus for dispensing a controlled amount of liquid compound onto a workpiece is described. The apparatus comprises a cartridge system. The cartridge system may accept a liquid compound cartridge containing liquid compound. The apparatus also comprises a plate, having a threaded bore, positioned above the cartridge system that is movable in a first and a second direction, at least one plunger attached to the plate at a first end and attached to a piston at a second end. The piston is dimensioned to move within the liquid compound cartridge to displace liquid compound when the plate is moved in the second direction. A driving mechanism moves the plate in the first and the second directions to dispense product and comprises a motor, a threaded rod disposed through the threaded bore of the plate that is driven by a driving belt attached to the motor.

BRIEF DESCRIPTION OF THE DRAWING(S)

DETAILED DESCRIPTION OF THE PREFERRED EMBODIMENT(S)

Figure 1:
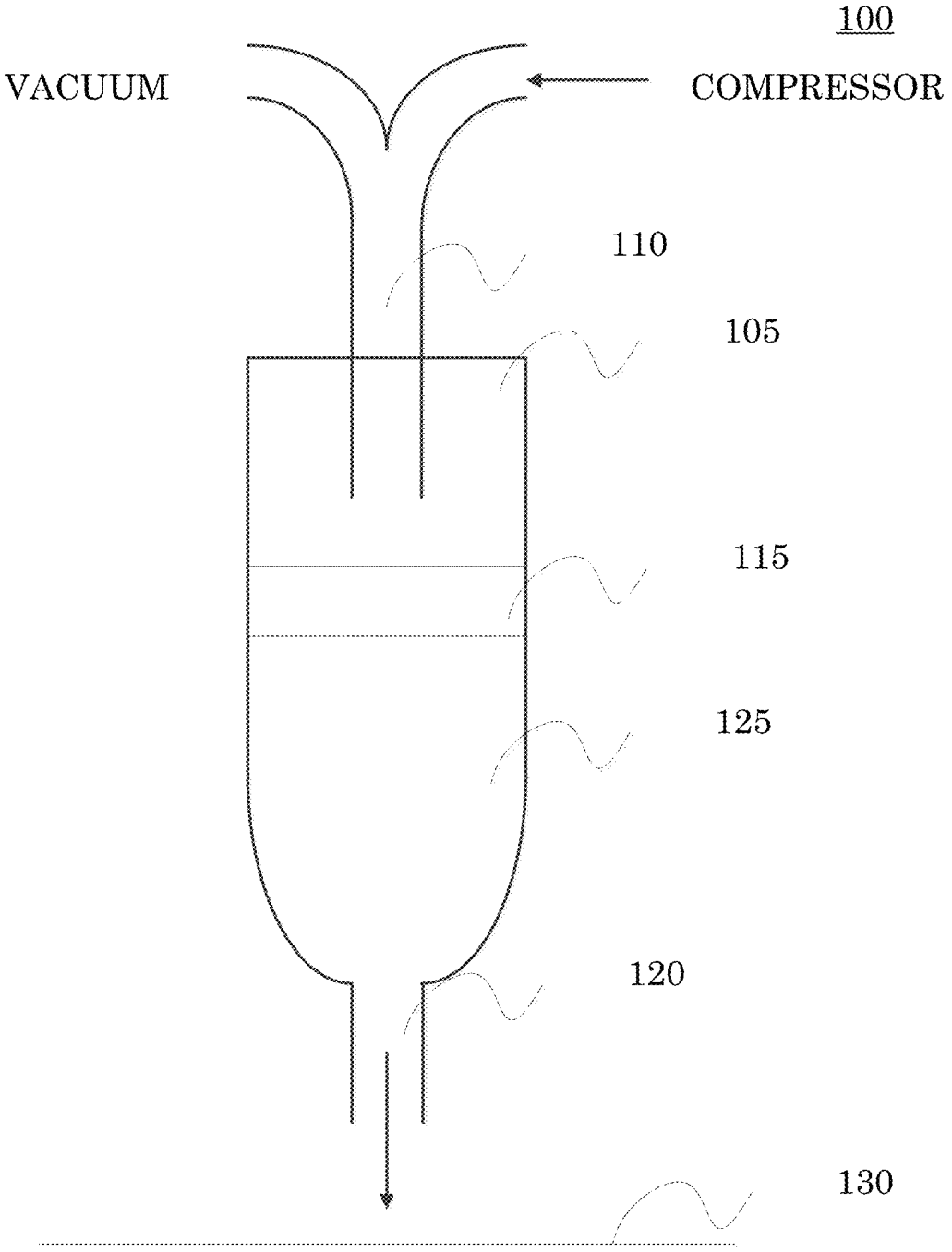
FIG. 1 is a diagram of a conventional time/pressure dispensing system.
Figure 2:
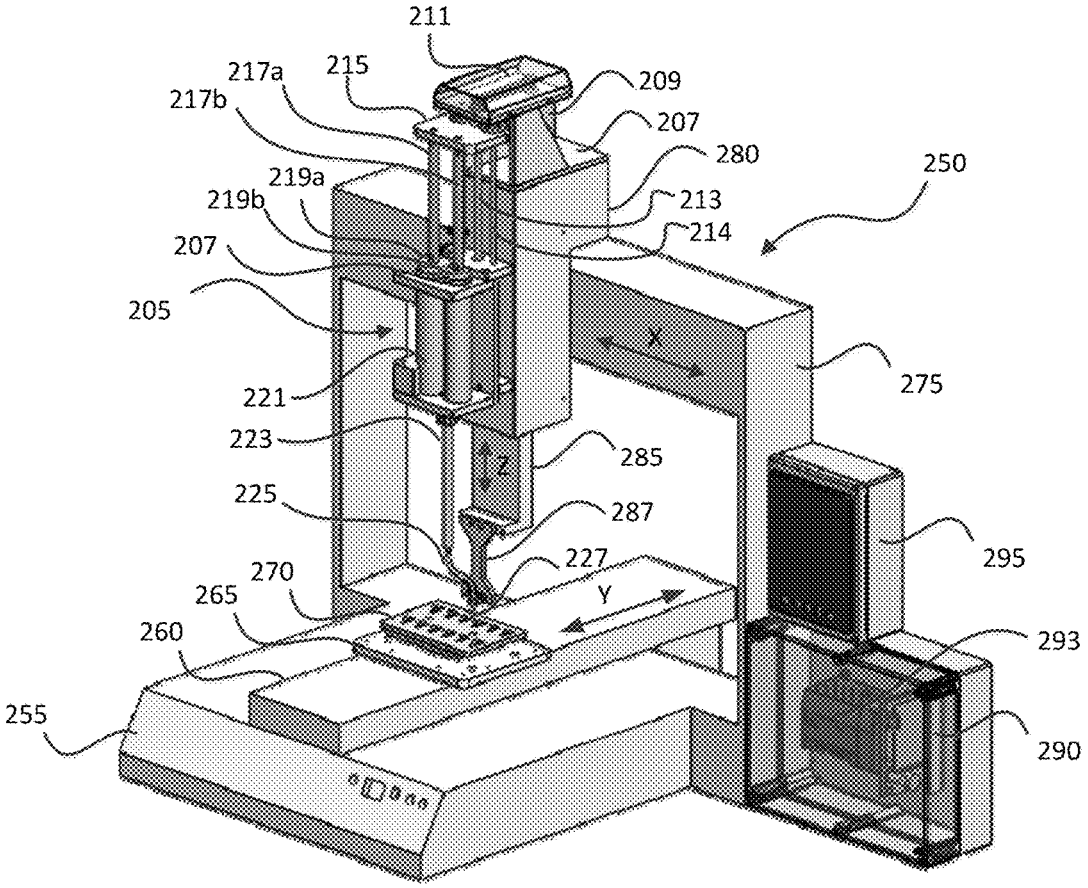
FIG. 2 is an isometric view of an example motorized liquid dispensing apparatus mounted on an X-Y-Z robotic table.

FIG. 2 is an isometric diagram of an example motorized liquid dispensing apparatus 205, in accordance with an embodiment of the invention. The motorized liquid dispensing apparatus 205 is shown mounted on an X-Y-Z-robotic table 250. The X-Y-Z robotic table 250 comprises a base member 255 that may house the robotic system components for driving the motorized liquid dispensing apparatus 205 in the "X", "Y" and "Z" directions. The base member 255 is stationary relative to its moving members. A Y-axis member 260 is slidably attached to base member 255 for movement in the "Y" direction. The Y-axis member 260 may include a plate 265 that may support a workpiece 270. Also attached to the base member 255 is X-axis member 275. In some embodiments, the X-axis member 275 is affixed with the base member 255 such that it is stationary. A robotic arm 280 is slidably attached to the X-axis member 275 for movement in the "X" direction across the X-axis member 275. The robotic arm 280 may include Z-axis member 285, which may be slidably attached to robotic arm 280 for movement in the "Z" direction. In one embodiment, robotic arm 280, Y-axis member 260, and Z-axis member 285 may be slidably moved along tracks using one or more motors. Additionally, one or more controllers, such as a microcontroller, processor, or other controller, may be housed in base member 255 and used to control the motor(s) associated with robotic arm 280, Y-axis member 260, and Z-axis member 285 to position the motorized liquid dispensing apparatus 205 in three dimensional space over workpiece 270.

Motorized liquid dispensing apparatus 205 may be mounted to the top and front portion of robotic arm 280 via mount 207. It should be noted that any mounting design may be used to mount the motorized liquid dispensing apparatus 205 onto any compatible desktop robot. In addition, the motorized liquid dispensing apparatus 205 may be mounted to a manually movable frame for positioning by a user.

Supported by mount 207 is motor unit 209 which may be attached to and may drive driving belt 211. The motor unit 209 may be a servo motor, a stepper motor, or the like. For example, a standard 2-phase stepper motor may be used, and may provide 200 full steps per full revolution, which is the equivalent of 1.8 degrees per step. Motor resolution may be increased by increasing the number of microsteps per full step. For example, each full step may include a total of 256 microsteps, which would result in 51,200 microsteps per one full revolution, which is the equivalent of 0.007 degrees per microstep. However, as shown in Table 1, below, increasing the number of microsteps per full step may result in a decrease in holding torque of the motor.

TABLE 1

MICROSTEPS PER FULL STEP AND RELATED PROPERTIES

| Microsteps/full step | Rotation per step | Holding Torque/Microstep |
|---|---|---|
| 1 | 1.8000° | 100.00% |
| 2 | 0.9000° | 70.71% |
| 4 | 0.4500° | 38.27% |
| 8 | 0.2250° | 19.51% |
| 16 | 0.1125° | 9.80% |
| 32 | 0.0563° | 4.91% |
| 64 | 0.0281° | 2.45% |
| 128 | 0.0141° | 1.23% |
| 256 | 0.0070° | 0.61% |

Therefore, motor selection and configuration may depend on the resolution and torque/accuracy requirements of the user. An optimal setting may be two (2) or four (4) microsteps per full step. Such a configuration may provide a sufficient amount of holding torque (i.e., 70.71% and 38.27%) as well as a sufficient level of precision. However, it should be noted that a user may vary the application to achieve more or less precision.

Referring again to FIG. 2, driving belt 211 is attached to and drives threaded rod 213. Threaded rod 213 is attached to front plate 215 and rotates to drive front plate 215 in the "Z" direction. Disposed through the front plate 215 is at least one guide rod 214 to prevent front plate 215 from moving in the "X" or "Y" directions. Threaded rod 213 may be easily detachable and may be of any configuration. For example, the threaded rod 213 may have a diameter of 10 millimeters (mm) and may have 5 threads per centimeter (cm), which may allow for a travel distance of 2 mm per full turn. It should be noted that one or more threaded rods, attached to one or more motor units, may be used to drive one or more front plates in the "Z" direction. The use of one motor unit and one threaded rod is for explanation purposes only and is not intended to be limiting.

Attached to front plate 215 are plungers 217*a*, 217*b* that terminate into pistons 219*a*, 219*b* which are driven in the "Z" direction via their attachment to front plate 215. Pistons 219*a*, 219*b* are driven into cartridge system 221 to displace the liquid compound housed in the cartridge system 221. In this way, the amount of volume of the liquid compound dispensed may be controlled by the displacement of compound in the cartridge system and the rate of speed at which it is displaced. In addition, dripping from the cartridge system may be controlled by releasing the pressure in the cartridge system by turning the motor unit in the opposite direction. Moreover, the cartridge system may be configured to automatically dispense preset volumes of liquid compound to prevent the liquid compound from curing.

Although shown as a two-part cartridge system, cartridge system 221 may be a multi-part cartridge system including more than two cartridges or may be a one-part cartridge system, having only a single cartridge. The cartridge system may also be easily detachable to accommodate different sized cartridge systems.

A mixer 223 is attached to cartridge system 221 and receives the liquid compound displaced from the cartridge system 221. In the two-part arrangement as shown, the mixer 223 serves to mix both component compounds together. The mixer may be removably attached to the cartridge system to allow for ease in cleaning the apparatus. A hose 225 is attached to mixer 223 and functions to carry the liquid compound to dispensing tip 227. Hose 225 may be removably attached to both the dispensing tip 227 and mixer 223. Hose 225 may be made from a flexible durable material such as polyurethane or the like. Hose 225 and dispensing tip 227 may be attached to Z-axis member 285 via Z-axis attachment plate 287.

Motor unit 209 may be controlled by motor driver unit 290 and control unit 293. Control unit 293 may include one or more processors, memory, and one or more programs. The one or more programs may be stored in the memory and configured to be executed by the one or more processors. The one or more programs may include instructions for operating the motorized liquid dispensing apparatus 205 and the X-Y-Z robotic table 250. The one or more programs may be presented to an operator by operator interface (OI) 295. OI 295 may include a display, a touch-sensitive surface, one or more processors, memory, and other components. The OI 295 may enable an operator to configure and control the motorized liquid dispensing apparatus 205 and X-Y-Z robotic table 250.

For example, the operator interface may allow an operator to select an operating configuration from a plurality of preset operating configurations. The associated memory may include a database of selectable operating configurations including a plurality of standard cartridge sizes, two-part compound application ratios, and the like that are selectable by the operator. Alternatively, an operator may input cartridge sizes and ratios, which may be added to the database stored in the memory.

The OI may also allow an operator to manually control movement of the front attachment plate 215 in the "Y" direction or return the front attachment plate 215 to a pre-configured home position. The OI may allow an operator to select from a plurality of dispensing speed presets. The plurality of dispensing speed presets may be preconfigured by the operator. For example, an operator may define a certain preset, (e.g., slow), by entering a specified dispensing rate, (e.g., in milliliters per minute).

The OI may also allow an operator to define auto purge parameters to dispense liquid compound during idle periods to prevent clogging. For example, an operator may set the idle time and volume of liquid compound to be purged. Additionally, the OI may also allow an operator to reset the system and return all parameters to a default setting.

Figure 3:
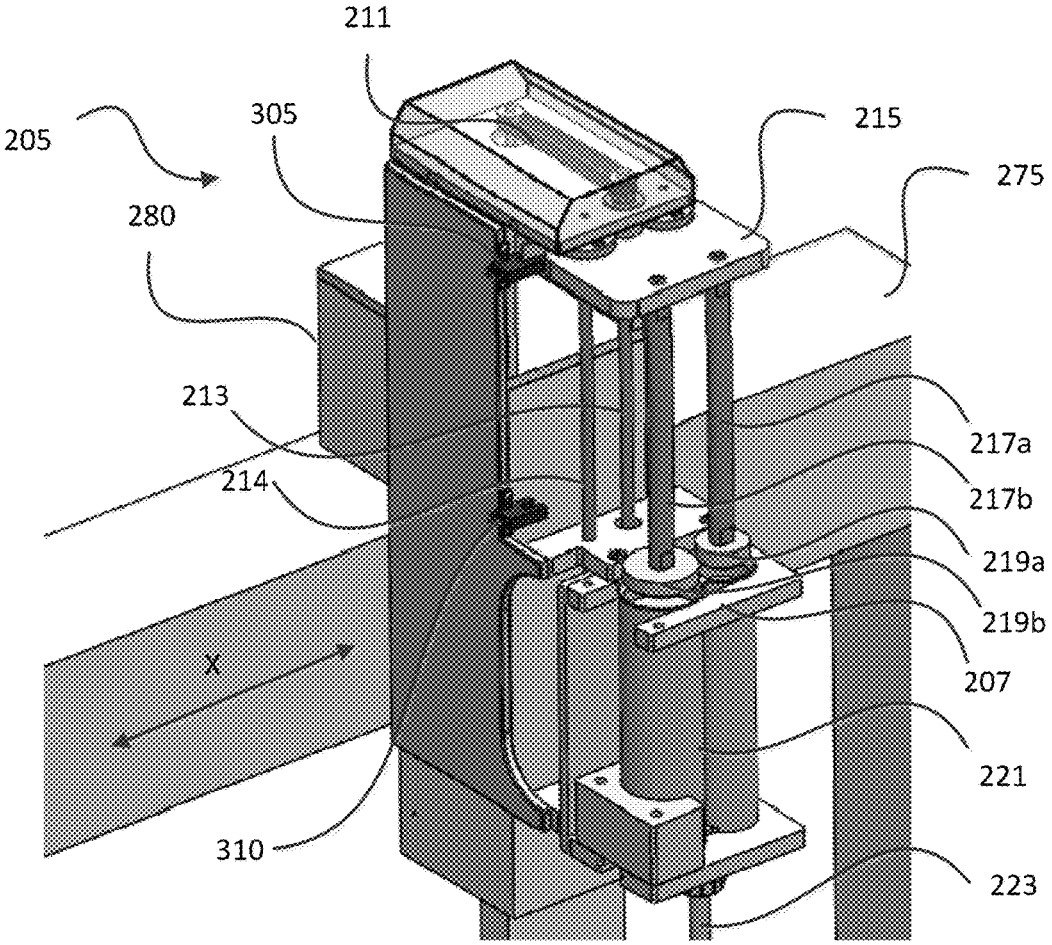
FIG. 3 is a zoomed reverse isometric view of a portion of the example motorized liquid dispensing apparatus of FIG. 2 with mounted sensors.

FIG. 3 is a zoomed reverse isometric view of the example motorized liquid dispensing apparatus 205 of FIG. 2 with mounted sensors. As shown in FIG. 3, home sensor 305 and lower limit sensor 310 may be attached to motorized liquid dispensing apparatus 205. The home sensor 305 may be connected to the control unit and may set an upper limit and home position for movement of front attachment plate 215. The lower limit sensor 310 may be connected to the control unit and may set a lower limit for travel of the front attachment plate 215. The lower limit sensor 310 may prevent the motor from driving front attachment plate 215 past its maximum travel position. Exceeding the maximum travel position may damage the motorized liquid dispensing apparatus 205. In some embodiments, as illustrated in FIG. 3, each of the home sensor 305 and the lower limit sensor 310 has a receiving member that is sized to receive a flange that is coupled to the front attachment plate 215. When flange is received by and in the receiving member of either the home sensor 305 or the lower limit sensor 310, further movement or traveling of the front attachment plate 215 in its current moving direction is limited or stopped.

The following formula may be used to determine the piston travel distance to dispense a desired volume of liquid compound in a single-part cartridge system:

$$\text{Piston travel distance} = \frac{V}{A}, \qquad \text{Equation 1}$$

where A is the cross section area of the single-part cartridge and V is the desired volume to be dispensed. To calculate piston travel distance to dispense a desired volume of liquid compound in a two-part cartridge system, the following formula may be used:

$$\text{Piston travel distance} = \frac{V}{(A_A + A_B)}, \qquad \text{Equation 2}$$

where $A_A$ is the area of a first cartridge of the two-part cartridge system, $A_B$ is the area of a second cartridge of the two-part cartridge system, and V is the desired volume to be dispensed.

For example, if the diameter of a standard 200 ml 1:1 two-part cartridge system is 37 mm per cartridge, given $A=\pi r^2$, the total area of two 200 ml cartridges may be defined as $A=\pi\times18.5\ \text{mm}^2+\pi\times18.5\ \text{mm}^2=2{,}150\ \text{mm}^2$. If 100 ml (i.e., 100 $\text{mm}^3$) of liquid compound is desired to be dispensed, $$\text{Piston travel distance} = \frac{V}{A_A + A_B} = \frac{100\ \text{mm}^3}{2{,}150\ \text{mm}^2} = 0.0465\ \text{mm}.$$

To determine the number of turns required by the threaded rod to drive the front plate the appropriate distance in the "Z" direction to achieve a dispensing of the desired volume, the following formula may be used:

$$\text{Number of turns} = \frac{\text{Piston Travel Distance}}{\text{Travel Distance per Turn}}. \qquad \text{Equation 3}$$

In this example, since the piston travel distance=0.0465 mm, using a threaded rod with a travel distance per turn=2 mm, Equation 3 will yield a total of 0.0233 turns to dispense a desired volume of 100 ml. The number of turns may then be converted to determine an equivalent rotation angle using the following formula:

$$\text{Rotation Angle}=360°\times\text{number of turns}, \qquad \text{Equation 4}$$

where one revolution is equal to 360°.

In the above example, Rotation Angle=360°×0.0233 turns=8.388°. If a 2 microstep driver is used (e.g., using 0.9000° rotations per step), the number of steps required to achieve a 8.388° rotation may be determined using the following formula:

$$\text{Number of } MicroSteps = \frac{\text{rotation angle}}{\text{rotation per } microstep}. \qquad \text{Equation 5}$$

In the above example, since the rotation angle=8.388°, and the rotations per microstep=0.9°, Equation 5 will yield 9.32 steps. In this case, if the motor is driven 10 steps, the total adhesive dispensed may be 107.5 ml, which yields an error margin of 7.5%. The error margin may be improved by using a finer threaded rod or a smaller sized cartridge.

Table 2, below, is a table comparing desired liquid dispensing volumes using a 2 microstep per full step motor configuration and 4 microstep per full step motor configuration. As shown in Table 2, the accuracy of the 4 microstep per full step motor configuration is generally more accurate than the 2 microstep motor. However, as noted above, the 4 microstep per full step motor configuration has less of holding torque when compared to the 2 microstep motor configuration.

TABLE 2

2 MICROSTEP V. 4 MICROSTEP COMPARISON TABLE

| | Piston | 2 microsteps/ full step | | | 4 microsteps/ full step | | |
|---|---|---|---|---|---|---|---|
| Desired Volume (ml) | Travel Distance (mm) | Steps | Actual Volume (ml) | Error % | Steps | Actual Volume (ml) | Error % |
| 100 | 0.046511628 | 10 | 107.5 | 7.50 | 19 | 102.125 | 2.13 |
| 200 | 0.093023256 | 19 | 204.25 | 2.13 | 38 | 204.25 | 2.13 |
| 300 | 0.139534884 | 28 | 301 | 0.33 | 56 | 301 | 0.33 |
| 400 | 0.186046512 | 38 | 408.5 | 2.13 | 75 | 403.125 | 0.78 |
| 500 | 0.23255814 | 47 | 505.25 | 1.05 | 94 | 505.25 | 1.05 |
| 600 | 0.279069767 | 56 | 602 | 0.33 | 112 | 602 | 0.33 |
| 700 | 0.325581395 | 66 | 709.5 | 1.36 | 131 | 704.125 | 0.59 |
| 800 | 0.372093023 | 75 | 806.25 | 0.78 | 149 | 800.875 | 0.11 |
| 900 | 0.418604651 | 84 | 903 | 0.33 | 168 | 903 | 0.33 |
| 1000 | 0.465116279 | 94 | 1010.5 | 1.05 | 187 | 1005.125 | 0.51 |
| 1500 | 0.697674419 | 140 | 1505 | 0.33 | 280 | 1505 | 0.33 |
| 2000 | 0.930232558 | 187 | 2010.25 | 0.51 | 373 | 2004.875 | 0.24 |

Although features and elements are described above in particular combinations, one of ordinary skill in the art will appreciate that each feature or element can be used alone or in any combination with the other features and elements.

What is claimed is:

1. A liquid compound dispensing apparatus for dispensing a controlled amount of a liquid compound onto a workpiece, the apparatus comprising:

a cartridge system for accepting at least one liquid compound cartridge containing the liquid compound to be dispensed;

a plate, having a threaded bore, positioned above the cartridge system and movable in a first direction and a second direction;

at least one plunger attached to the plate at a first end of the at least one plunger and attached to a piston at a second end of the at least one plunger, wherein the piston is dimensioned to move within the at least one liquid compound cartridge to displace the liquid compound when the plate is moved in the second direction; and a driving mechanism configured to move the plate in the first direction and the second direction and said driving mechanism configured to dispense the liquid compound, said driving mechanism comprising:

a motor; and a threaded rod attached to the motor via a driving belt, wherein the threaded rod is disposed through the threaded bore of the plate, wherein the threaded rod is rotated by the motor via the driving belt to drive the plate in the second direction to dispense the liquid compound from the cartridge system; said motor is located above said plate and above at least one guide rod; and said liquid compound dispensing apparatus is mounted to the top and front portion of a robotic arm; said robotic arm located below said motor; said robotic arm includes a Z-axis member movable in said first direction and second direction, said Z-axis member is connected to a dispensing tip connected to an end of the cartridge system; and said at least one guide rod located between said at least one plunger and the robotic arm; said guide rod disposed through the plate.

2. The apparatus of claim 1, further comprising:

a mixer attached to an inferior end of the cartridge system for mixing the liquid compound dispensed from the at least one liquid compound cartridge; a hose attached to an inferior end of the mixer; and the dispensing tip attached to an inferior end of the hose for dispensing the liquid compound onto a working piece disposed under the dispensing tip.

3. The apparatus of claim 1, wherein the motor is a stepping motor.

4. The apparatus of claim 1, wherein the liquid compound dispensing apparatus is attached to an X-Y-Z robotic table for positioning the liquid compound dispensing apparatus in three dimensional space over the work piece.

5. The apparatus of claim 3, wherein the stepping motor is rotatable in response to a pulse signal provided by a control unit.

6. The apparatus of claim 3, wherein the stepping motor is configured to perform 200 full steps per revolution.

7. The apparatus of claim 6, wherein the stepping motor is further configured to perform 1 microstep per full step.

8. The apparatus of claim 6, wherein the stepping motor is further configured to perform 2 microsteps per full step.

9. The apparatus of claim 5, further comprising: an operator interface (OI) connected to the control unit for allowing user control of the liquid compound dispensing apparatus.

10. The apparatus of claim 5, wherein the control unit is configured to provide a pulse signal to the stepper motor during an idle period to dispense a controlled volume of liquid compound.

* * * * *